US010720129B2

(12) United States Patent
Berg

(10) Patent No.: US 10,720,129 B2
(45) Date of Patent: Jul. 21, 2020

(54) REVERSIBLE HEIGHT ADJUSTABLE GUITAR NUT

(71) Applicant: Sean Michael Berg, Rice Lake, WI (US)

(72) Inventor: Sean Michael Berg, Rice Lake, WI (US)

( * ) Notice: Subject to any disclaimer, the term of this patent is extended or adjusted under 35 U.S.C. 154(b) by 44 days.

(21) Appl. No.: 15/691,718

(22) Filed: Aug. 30, 2017

(65) Prior Publication Data

US 2018/0061378 A1 Mar. 1, 2018

Related U.S. Application Data

(60) Provisional application No. 62/381,605, filed on Aug. 31, 2016.

(51) Int. Cl.

| | |
|---|---|
| ***G10D 3/12*** | (2006.01) |
| ***G10D 3/06*** | (2006.01) |
| ***G10D 1/08*** | (2006.01) |

(52) U.S. Cl.

CPC ..... *G10D 3/12* (2013.01); *G10D 1/08* (2013.01); *G10D 3/06* (2013.01)

(58) Field of Classification Search

CPC ..... G10D 3/12; G10D 3/06; G10D 1/08

See application file for complete search history.

(56) References Cited

U.S. PATENT DOCUMENTS

| | | | | |
|---|---|---|---|---|
| 1,307,501 | A * | 6/1919 | Kirk | G10D 3/06 84/314 N |
| 1,338,583 | A * | 4/1920 | Neft | G10D 3/12 84/314 N |
| 9,159,303 | B1 * | 10/2015 | Garrick | G10D 3/04 |
| 2004/0159204 | A1 * | 8/2004 | Rose | G10D 3/04 84/298 |
| 2014/0216230 | A1 * | 8/2014 | Johns | G10D 1/085 84/314 R |

* cited by examiner

*Primary Examiner* — Daniel J Colilla

(74) *Attorney, Agent, or Firm* — Michael R Shevlin

(57) ABSTRACT

The present invention discloses a reversible, height adjustable guitar nut that allows quick reversal from right-handed to left-handed and easy adjustment of the nut height. The reversible, height adjustable guitar nut uses two screws to hold it in a slot of the guitar neck. Removal of the two screws allows the guitar nut plate to be removed from the guitar, rotate the nut plate to switch from right to left handed, and reinstalled on the guitar. The two screws are also designed to provide adjust capability to the height of the guitar nut as needed.

5 Claims, 3 Drawing Sheets

REVERSIBLE HEIGHT ADJUSTABLE GUITAR NUT

CROSS-REFERENCE TO RELATED APPLICATIONS

This application claims priority from U.S. Provisional Patent Application No. 62/381,605, filed on Aug. 31, 2016, the contents of which is incorporated herein by reference.

FIELD

The present invention relates to field of musical instruments, specifically a reversible, height adjustable guitar nut that allows quick reversal from right-handed to left-handed and easy adjustment of the guitar nut height.

BACKGROUND

Most guitars are built to play either right-handed or left-handed with the guitar strings attached in a particular order between the bridge and neck. To switch a guitar from right-handed to left-handed play requires removal and reattachment of the guitar strings in reverse order. This reversal may be a long and cumbersome process to complete.

What is needed is an easily reversible guitar system and method for converting a right-handed guitar to a left-handed guitar in a reversible manner.

SUMMARY OF THE INVENTION

The present invention discloses a reversible, height adjustable guitar nut that allows quick reversal from right-handed to left-handed and easy adjustment of the nut height. The reversible, height adjustable guitar nut uses two screws to hold it in a slot of the guitar neck. Removal of the two screws allows the guitar nut plate to be removed from the guitar, rotate the nut plate to switch from right to left handed, and reinstalled on the guitar. The two screws are also designed to provide adjustment capability to the height of the guitar nut as needed.

There has thus been outlined, rather broadly, the more important features of the invention in order that the detailed description thereof may be better understood, and in order that the present contribution to the art may be better appreciated. There are additional features of the invention that will be described hereinafter and which will form the subject matter of the claims appended hereto. The features listed herein and other features, aspects and advantages of the present invention will become better understood with reference to the following description and appended claims.

BRIEF DESCRIPTION OF THE DRAWINGS

The present embodiments may be understood from the following detailed description when read in conjunction with the accompanying figures. It is emphasized that the various features of the figures are not necessarily to scale. On the contrary, the dimensions of the various features may be arbitrarily expanded or reduced for clarity.

DETAILED DESCRIPTION

Embodiments of the invention will now be described with reference to the figures, wherein like numerals reflect like elements throughout. The terminology used in the description presented herein is not intended to be interpreted in any limited or restrictive way, simply because it is being utilized in conjunction with detailed description of certain specific embodiments of the invention. Furthermore, embodiments of the invention may include several novel features, no single one of which is solely responsible for its desirable attributes or which is essential to practicing the invention described herein.

Overview

The problem the present invention set out to solve was the ability to reverse a guitar nut from left to right handed, and vice versa, without performing any modifications or adjustments. This was done with an overall easily reversible guitar in mind. Now, expanding on this idea, the reversible guitar nut and in an overall sense, the reversible guitar, would be a valuable commodity in the classroom setting and in the studio, where you do not normally find a left handed guitar. But with the reversible nut anyone can use it, left or right handed, with very little down time.

Figure 1:
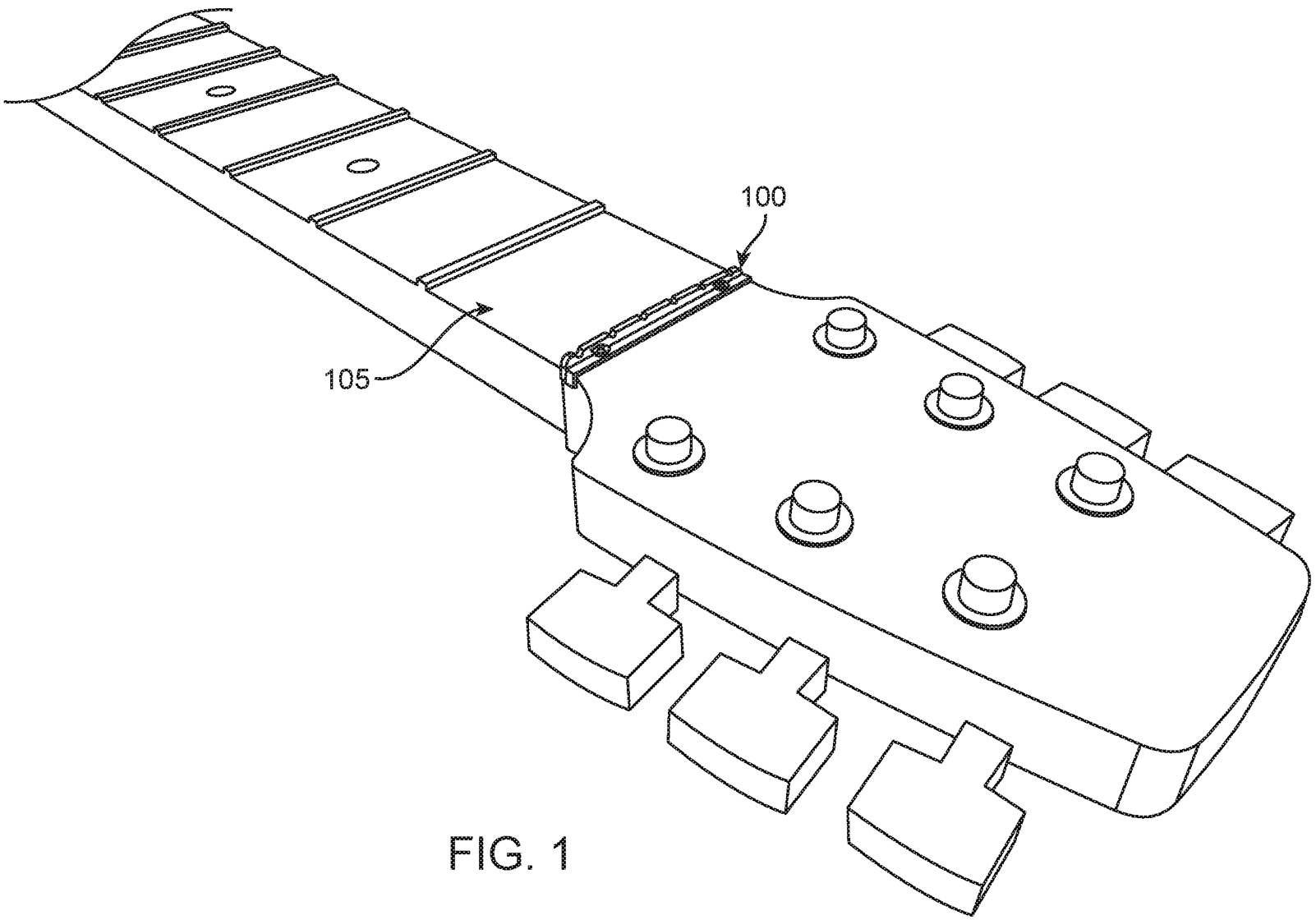
FIG. 1 shows one embodiment of a reversible, height adjustable guitar nut 100 mounted on a guitar.

FIG. 1 shows one embodiment of a reversible, height adjustable guitar nut 100 mounted on a guitar 105 that allows quick reversal from right-handed to left-handed and easy adjustment of the nut height. The reversible, height adjustable guitar nut uses two screws to hold it in a slot of the guitar neck. Removal of the two screws allows the guitar nut plate to be removed from the guitar, rotate the nut plate to switch from right to left handed, and reinstalled on the guitar. The two screws are also designed to provide adjust capability to the height of the guitar nut as needed.

Figure 2A:
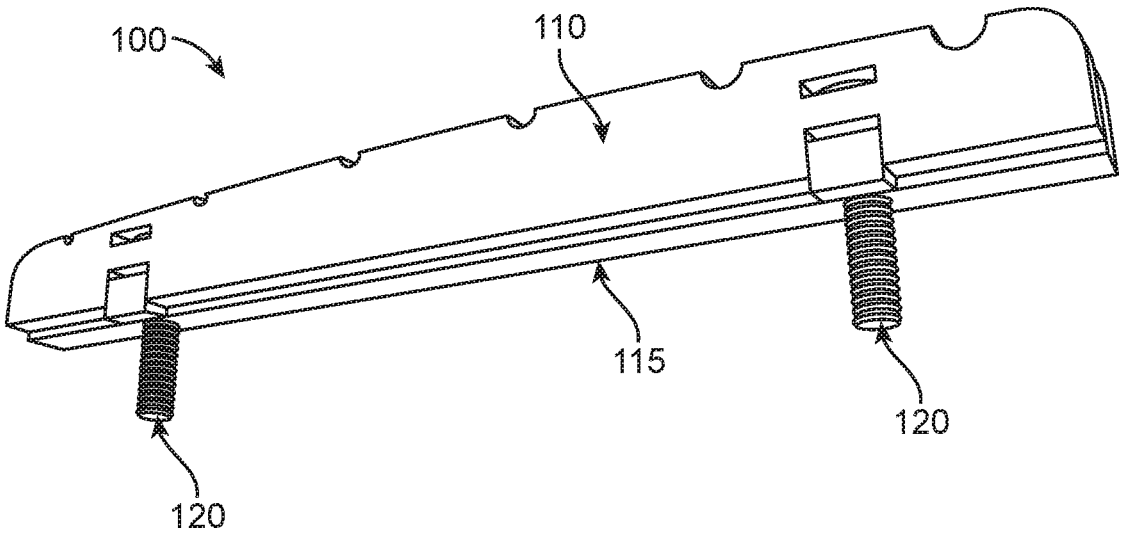
FIGS. 2A and 2B are front and rear views showing the reversible, height adjustable guitar nut.
Figure 2B:
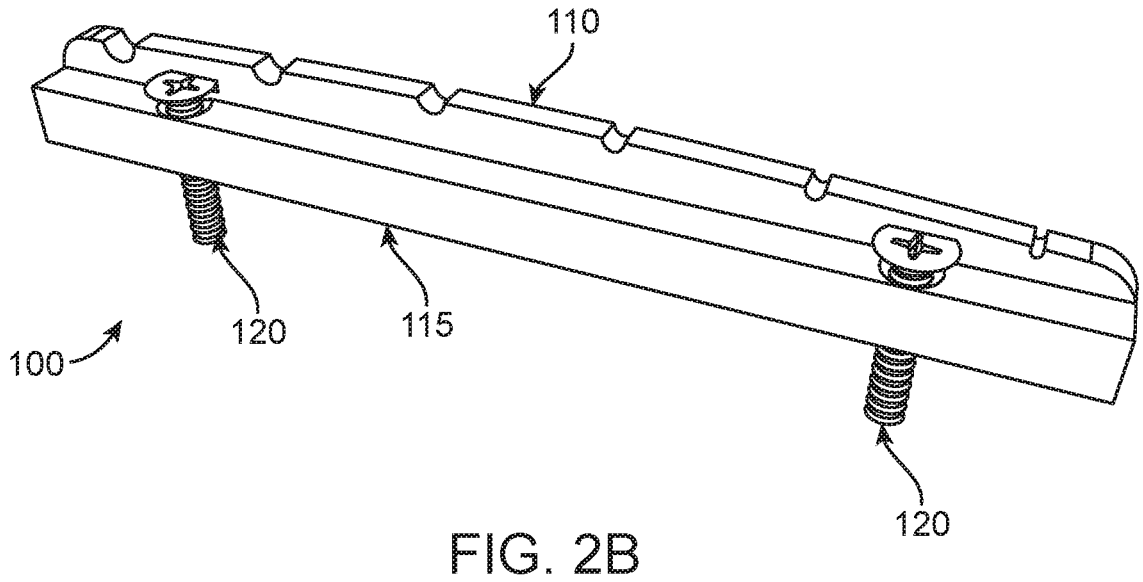

FIGS. 2A and 2B are front and rear views showing the reversible, height adjustable guitar nut 100 having a nut plate 110, a nut base 115, and nut mount/plate adjustment screws 120. The reversible, height adjustable guitar nut 100 uses the two screws 120 to attach the guitar nut 100 in a slot of the guitar neck. The slot of the guitar neck has two holes drilled in it (shown in FIG. 3) to accommodate the screws of the reversible, height adjustable guitar nut to clear the holes without using threads. These screws are also used to adjust the height of the nut by holding the nut plate to the desired height via the plate adjust slots (shown in FIG. 3) in the plate resting on the top of the screws. The screws are threaded to the nut base. The nut base also guides the nut plate up and down via the plate guides (shown in FIG. 3) mated to the corresponding plate guide slots on the nut plate.

Guitar Nut Components

Figure 3:
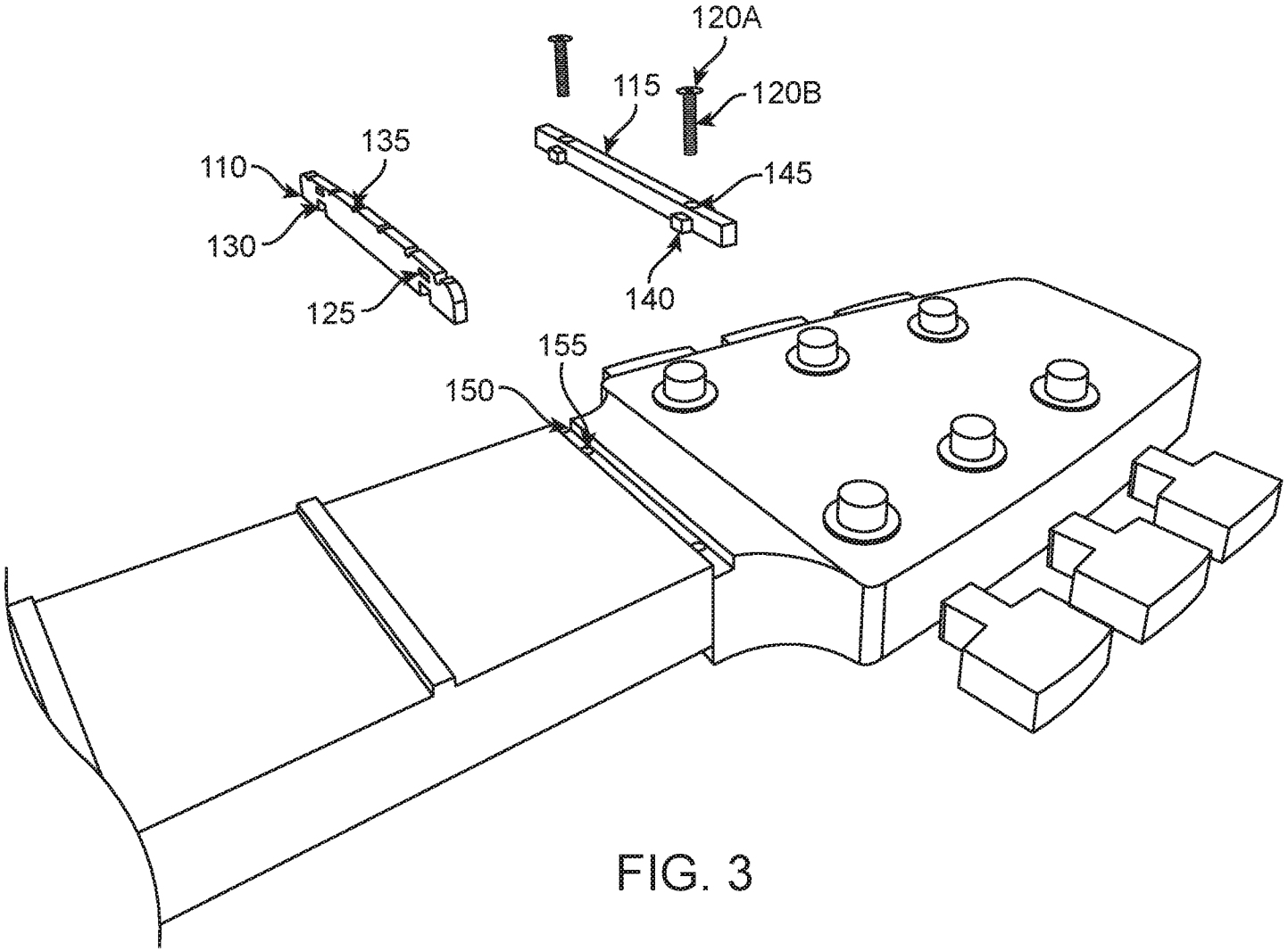
FIG. 3 shows an exploded view of reversible, height adjustable guitar nut.

FIG. 3 shows an exploded view of reversible, height adjustable guitar nut 100 that consists of the following components:

One Nut Plate 110

One Nut Base 115

Two Nut Mount/Nut Plate Adjustment Screws 120

The nut plate 110 includes a plate adjust slot 125, plate guide slot 130, and multiple guitar string slots 135. The nut base 115 includes plate guides 140 and screw holes 145. The plate guides 140 are sized to engage the guide slots 130. The screw 120 includes a head portion 120*a* and a threaded portion 120*b*. The head portion 120*a* is configured to engage plate adjust slot 125. These screws are used to adjust the height of the guitar nut 100 by holding the nut plate 110 to the desired height via the plate adjust slots 125 in the plate resting on the top of the screws. The screws are threaded to the nut base. The nut base 115 also guides the nut plate 110 up and down via the plate guides 140 mated to the corresponding plate guide slots 130 on the nut plate 110.

The guitar may include a slot 150 that is sized to fit the slot-mounted guitar nut 100 and the guitar neck has two holes 155 drilled in it to accommodate the screws 120 of the reversible, height adjustable guitar nut to clear the holes without using threads.

Reversing and Adjusting the Guitar Nut

The guitar nut 100 is designed for quick reversal from right-handed to left-handed, and easy adjustment of the nut height. Reversing the reversible, height adjustable guitar nut consists of the following steps:

1. Loosen the guitar's strings.
2. Lift the reversible, height adjustable guitar nut from the nut slot of the guitar's neck, turn the nut 180 degrees, then put the nut back in the slot.
3. Adjust the height of the reversible, height adjustable guitar nut if needed, then tune the guitar.

Adjusting the height of the reversible, height adjustable guitar nut is accomplished by turning nut mount/nut plate adjustment screws such that the nut plate sits at the desired height.

While embodiments and applications of this invention have been shown and described, it would be apparent to those skilled in the art that many more modifications than mentioned above are possible without departing from the inventive concepts herein. It is to be understood that the present disclosure is illustrative only and that changes, variations, substitutions, modifications and equivalents will be readily apparent to one skilled in the art and that such may be made without departing from the spirit of the invention as defined by the following claims.

The invention claimed is:

1. A reversible, height adjustable guitar nut comprising:

a nut plate having multiple guitar string slots configured to engage guitar strings;

a nut base slidably coupled with one or more nut plate guide slots; and one or more nut mount/nut plate adjustment screws configured to engage the nut plate and nut base, wherein turning the nut mount/nut plate adjustment screws adjusts the height of the guitar nut plate in relation to the nut base;

wherein the nut plate includes one or more plate adjust slots, and the nut mount/nut plate adjustment screws include a head portion configured to engage the one or more plate adjust slots.

2. A reversible, height adjustable guitar nut comprising:

a nut plate having multiple guitar string slots configured to engage guitar strings;

a nut base slidably coupled with one or more nut plate guide slots; and one or more nut mount/nut plate adjustment screws configured to engage the nut plate and nut base, wherein turning the nut mount/nut plate adjustment screws adjusts the height of the guitar nut plate in relation to the nut base;

wherein the nut base includes one or more threaded screw holes, and each nut mount/nut plate adjustment screw includes a threaded portion configured to engage the screw hole.

3. A reversible, height adjustable guitar nut comprising:

a nut plate having one or more plate adjust slots, one or more plate guide slots, and multiple guitar string slots configured to engage guitar strings;

a nut base having one or more nut plate guides and one or more nut mount threaded screw holes, the nut plate guides being slidably coupled with the one or more nut plate guide slots; and one or more nut mount screws having a threaded portion configured to engage the threaded screw holes and a head portion configured to engage the one or more plate adjust slots;

wherein the guitar nut is sized to fit in a guitar neck slot in reversible directions and the screws are configured to adjust the height of the guitar nut by holding the nut plate to the desired height via the plate adjust slots engagement with the screw heads.

4. A guitar having a reversible, height adjustable guitar nut comprising:

a guitar body having a guitar neck with a guitar nut slot; and a guitar nut configured to reversibly fit in the guitar nut slot, the guitar nut comprising a nut plate having multiple guitar string slots configured to engage guitar strings;

a nut base slidably coupled with the one or more nut plate guide slots; and one or more nut mount/nut plate adjustment screws configured to engage the nut plate, nut base and guitar neck;

wherein turning the nut mount/nut plate adjustment screws adjusts the height of the guitar nut on the guitar neck.

5. The guitar of claim 4, wherein the nut plate includes one or more plate guide slots and one or more plate adjust slots, wherein the plate guide slots are slidably coupled with one or more nut plate guide slots of the nut base, and the plate adjust slots are configured to engage a head portion of the screws.

* * * * *